US012509191B1

(12) United States Patent
Powers et al.

(10) Patent No.: US 12,509,191 B1
(45) **Date of Patent: *Dec. 30, 2025**

(54) INSERT FOR KINETIC INFINITY MOUNT SYSTEM

(71) Applicants: Bryan Austin Powers, Sparks, NV (US); Jenness Donnett Powers, Sparks, NV (US)

(72) Inventors: Bryan Austin Powers, Sparks, NV (US); Jenness Donnett Powers, Sparks, NV (US)

( * ) Notice: Subject to any disclaimer, the term of this patent is extended or adjusted under 35 U.S.C. 154(b) by 559 days.

This patent is subject to a terminal disclaimer.

(21) Appl. No.: 17/960,067

(22) Filed: Oct. 4, 2022

Related U.S. Application Data

(63) Continuation-in-part of application No. 17/148,558, filed on Jan. 13, 2021, now Pat. No. 11,565,777, which is a continuation of application No. 16/460,088, filed on Jul. 2, 2019, now Pat. No. 10,933,956.

(51) Int. Cl.
*B63B 32/66* (2020.01)
*B63B 32/60* (2020.01)

(52) U.S. Cl.
CPC ..... *B63B 32/60* (2020.02); *B63B 32/66* (2020.02)

(58) Field of Classification Search
CPC ..... B63B 32/64; B63B 32/60; B63B 32/66
See application file for complete search history.

(56) References Cited

U.S. PATENT DOCUMENTS

| | | | | |
|---|---|---|---|---|
| 5,464,359 A | 11/1995 | Whitty | A63C 15/05 441/79 |
| 6,053,789 A * | 4/2000 | Miyashiro | B63B 32/64 114/140 |
| 6,213,044 B1 * | 4/2001 | Rodgers | B63B 32/66 441/79 |
| 6,386,933 B1 | 5/2002 | Rewald | B63B 32/66 441/74 |
| 6,439,940 B1 * | 8/2002 | Pouchkarev | B63B 32/64 441/74 |
| 6,793,548 B2 | 9/2004 | Jolly | B63B 32/66 441/79 |
| 7,025,645 B1 | 4/2006 | Hsieh | B63B 32/66 441/79 |

(Continued)

*Primary Examiner* — Andrew Polay
(74) *Attorney, Agent, or Firm* — Adibi IP Group, PC; Amir V. Adibi; Andrew C. Palmer

(57) ABSTRACT

A Kinetic Infinity Mount System (KIMS) comprises an outer housing, first and second outer gears, first and second inner gears, two pins, screws, two mechanical collars, a fin box, and a fin box insert. The KIMS allows different reusable and removable fins to be mounted onto a surfboard or other waterborne vessels. The KIMS provides dynamic, simultaneous adjustment and setting of a toe angle and a camber angle of the fin. The fin box insert provides more stability for the fin. Users choose from multiple settings of positive or negative toe angle or camber angle for each fin mounted into the surfboard. Camber and toe angles, in both positive or negative directions, can be adjusted simultaneously or separately to the user's preference. The KIMS allows different types of fins by FCS®, Futures®, or similar, rectangular-based fins to be mounted into the fin box and adjusted to desired configuration.

9 Claims, 16 Drawing Sheets

(56) References Cited

U.S. PATENT DOCUMENTS

| | | | | |
|---|---|---|---|---|
| 7,108,571 | B2 | 9/2006 | Geraghty | B63B 32/66 441/79 |
| 7,285,031 | B2 | 10/2007 | Mair | B63B 32/66 114/140 |
| 8,632,272 | B2 | 1/2014 | Wojtowicz et al. | B63B 35/79 441/79 |
| 8,632,373 | B2 | 1/2014 | Chambers | B63B 32/60 441/79 |
| 8,845,374 | B2 * | 9/2014 | Higgins | B63B 32/66 441/79 |
| 9,688,365 | B2 | 6/2017 | Norrie | B63B 32/64 |
| 9,751,600 | B2 | 9/2017 | Elliott et al. | B63B 1/00 35/793 |
| 9,896,168 | B1 | 2/2018 | Lindbergh | B63B 32/60 |
| 9,957,021 | B2 | 5/2018 | Scott | B63B 32/66 |
| 2002/0155769 | A1 | 10/2002 | Herbert | B63B 32/66 441/79 |
| 2004/0248482 | A1 | 12/2004 | Larkin | B63B 32/64 441/79 |
| 2015/0239532 | A1 | 8/2015 | Wood | B63B 35/79 441/79 |
| 2019/0233062 | A1 | 8/2019 | Muller | B63B 32/64 |
| 2022/0041253 | A1 * | 2/2022 | Khaladj | B63B 32/66 |

* cited by examiner

FIG. 6A
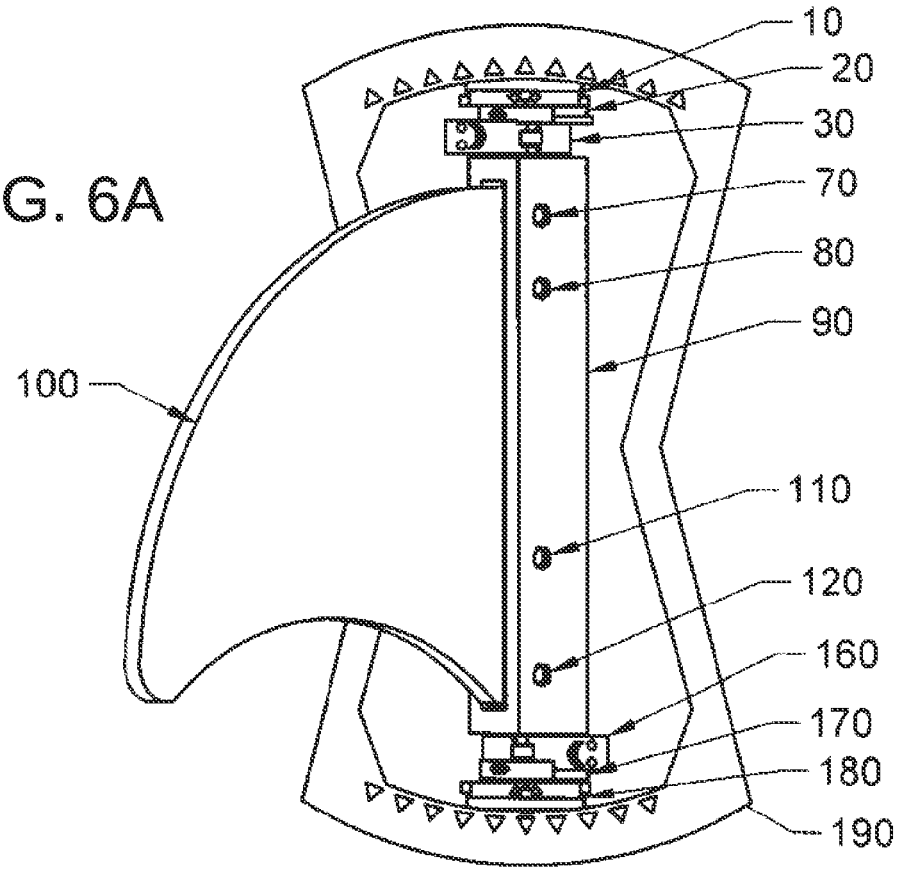
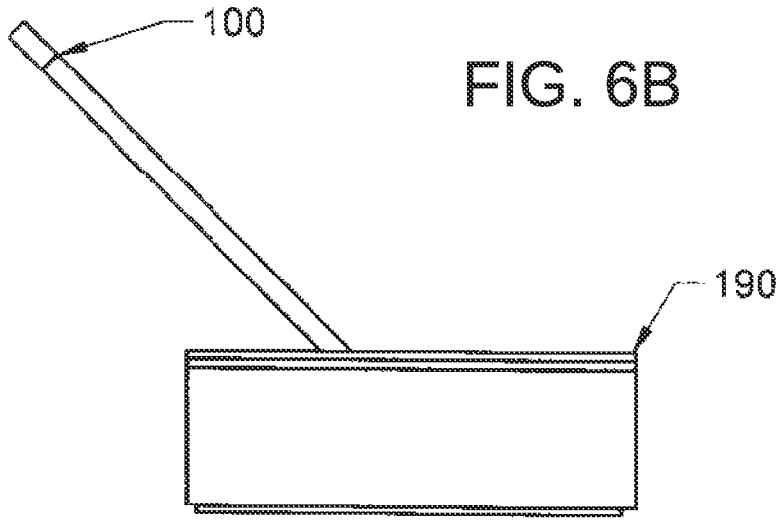
FIG. 6B

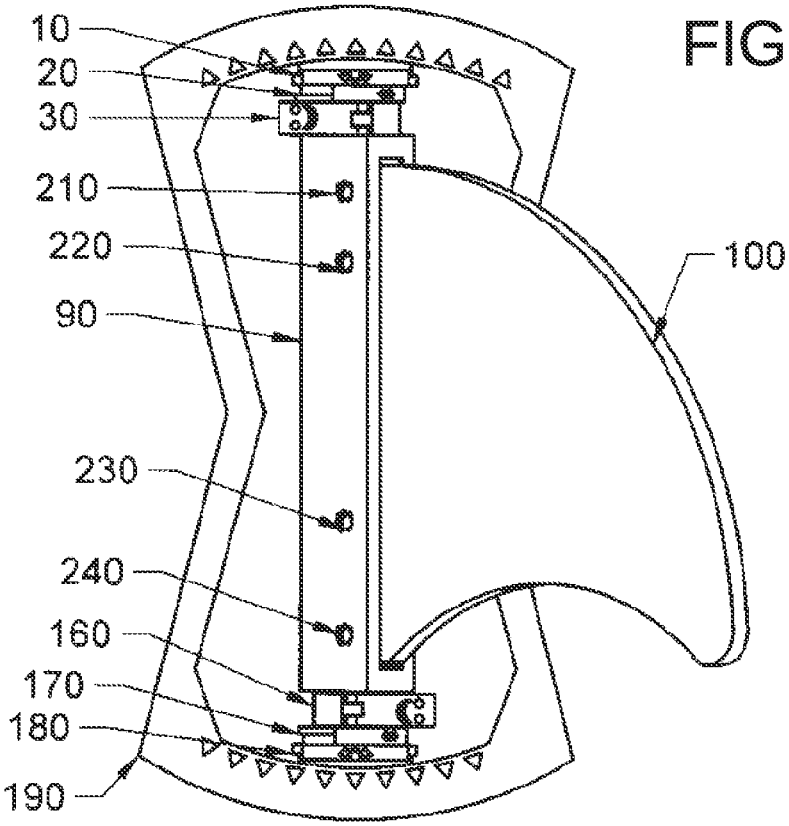
FIG. 7A
FIG. 7B
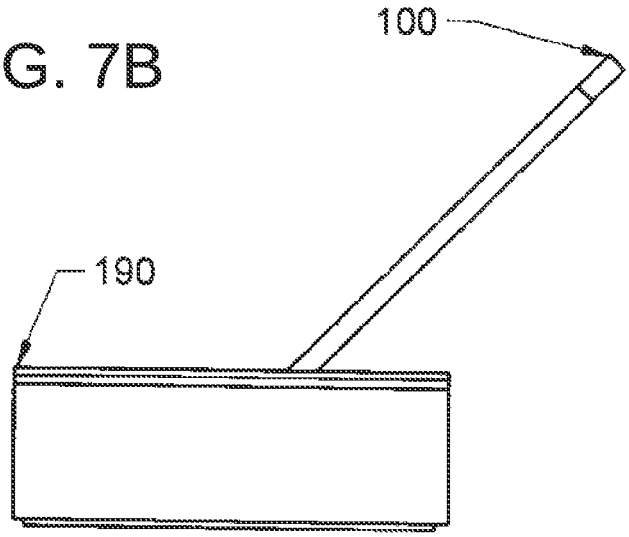

INSERT FOR KINETIC INFINITY MOUNT SYSTEM

CROSS-REFERENCE TO RELATED APPLICATIONS

This application is a continuation-in-part of, and claims the benefit under 35 U.S.C. § 120 from, nonprovisional U.S. patent application Ser. No. 17/148,558, entitled "Kinetic Infinity Mount System," filed on Jan. 13, 2021. U.S. patent application Ser. No. 17/148,558 in turn is a continuation of, and claims the benefit under 35 U.S.C. § 120 from, nonprovisional U.S. patent application Ser. No. 16/460,088, entitled "Kinetic Infinity Mount System (KIMS)," filed on Jul. 2, 2019, now U.S. Pat. No. 10,933,956. The entire subject matter of the foregoing documents is expressly incorporated herein by reference.

TECHNICAL FIELD

The present invention relates generally to water sport equipment.

BACKGROUND INFORMATION

The art of surfing dates back many years. One of the pieces of equipment used to surf is the surfboard. A surfboard fin or skeg attached to the back of the surfboard was introduced in the 1930s as a way to modernize the surfboard. Surfboard fins come in many configurations, such as the single fin, the twin fin, the thruster, and the quad. The fin is used to drive and lift the surfboard while riding the board on a wave.

SUMMARY

A Kinetic Infinity Mount System (KIMS) comprises an outer housing, first and second outer gears, first and second inner gears, two pins, two screws, two mechanical collars, and a fin box. The fin box includes two screw holes on each end and four screw holes on both of the sides. These parts are configured in such a manner to allow users to choose from multiple settings of positive or negative toe angles for each fin mounted into the surfboard. In addition, the KIMS provides the user the ability to adjust camber angle utilizing multiple settings, either positive or negative, for each fin mounted into the surfboard. Camber and toe angles, in both positive or negative directions, can be adjusted simultaneously or separately to the user's preference.

The teeth on the outer housing allow for movement of 90 degrees of camber and/or 60 degrees of total toe movement. Alternatively, when the fin box is set in the neutral camber and neutral toe position, as shown in FIGS. 4A-4B, the fin box has a movement range between 30 degrees toe positive (away from the surfboard nose) and 30 degrees toe negative (towards the nose of the surfboard). The camber from the neutral position, as shown in FIGS. 4A-4B, can be adjusted up to 45 degrees away from the nose of the surfboard or negative 45 degrees towards the nose of the surfboard. It is understood that these prescriptive degree values are subject to change due to manufacturer's capabilities and/or customer requests.

The fin box is also referred to as a "universal fin box" because the fin box fits any type of fin. For example, the KIMS fin box accepts FCS®, FCS II®, and Futures® fins or similar, rectangular-based fins. The fin manufactured by FCS® or Futures® can be attached to the fin box with a hex key (allen wrench). The fin is fastened to the fin box using hexagonal head screws. The novel fin box allows various fins (e.g.—FCS®, FCS II®, and Futures®) to all be attached using the same method.

Fins throughout the history of surfing have been static, meaning the user could not change the fin position once the fins were set in the board. The KIMS is the first fin system to allow the user to have fully dynamic fin movement capabilities of fin toe movement of left to right and fin camber-tilting movement of left and right. The KIMS will also be the first of its kind to allow the user to attach the fin to the fin box using a hex key, utilizing the same method for similar, rectangular-based fins.

Further details and embodiments and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

FIG. JA is a diagram showing the internal components of the Kinetic Infinity Mount System (KIMS).

FIG. 6A is a plan view illustration of the KIMS fin box depicting camber set in a positive direction and toe set in a neutral direction.

FIG. 6B is a transverse view illustration of the KIMS fin box depicting camber set in a positive direction and toe set in a neutral direction.

FIG. 7A is a plan view illustration of the KIMS fin box depicting camber set in a negative direction and toe set in a neutral direction.

FIG. 7B is a transverse view illustration of the KIMS fin box depicting camber set in a negative direction and toe set in a neutral direction.

DETAILED DESCRIPTION

Figure 1A:
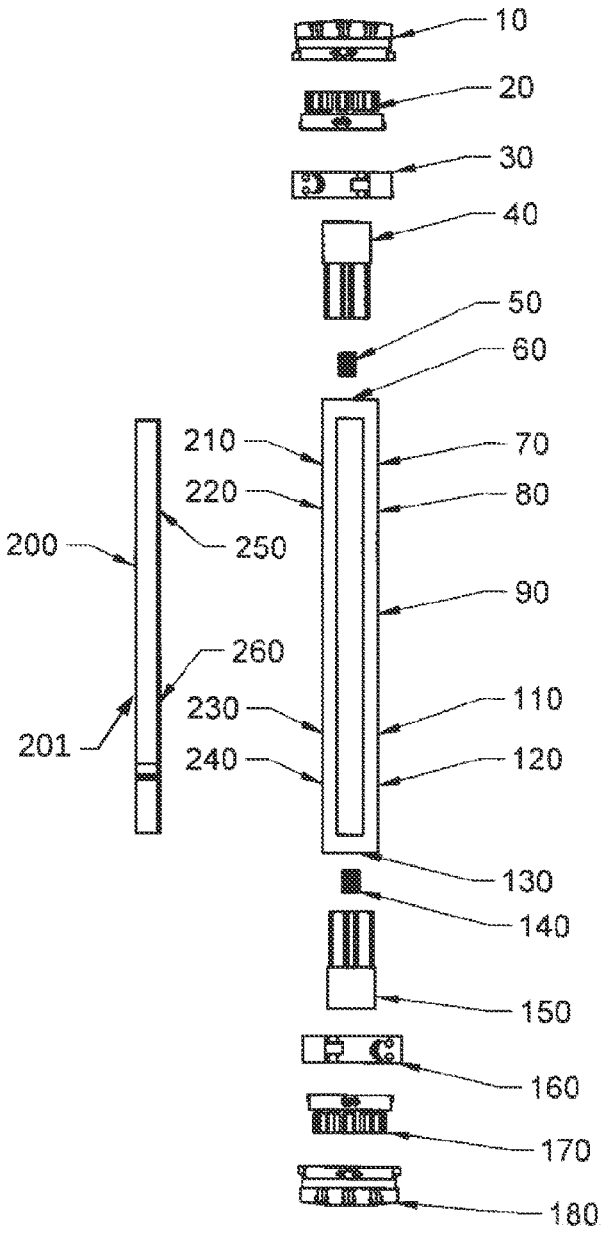
FIG. 1B is a diagram showing another embodiment of the KIMS.
FIG. 1C shows another embodiment of the KIMS.
FIG. 1D shows an isometric view of the KIMS embodiment shown in FIG. 1C.
Figure 1B:
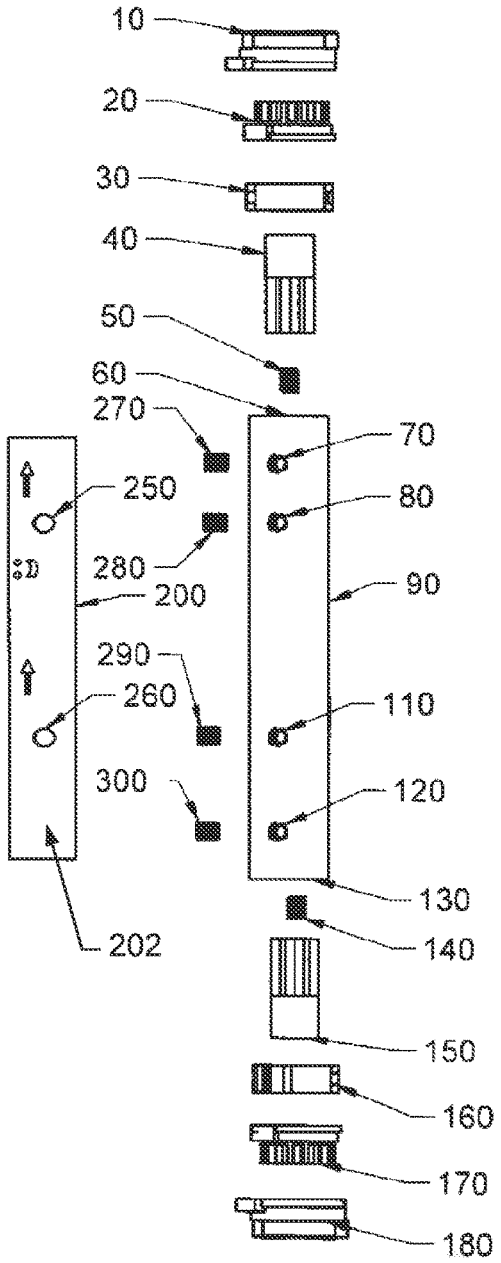
Figure 1C:
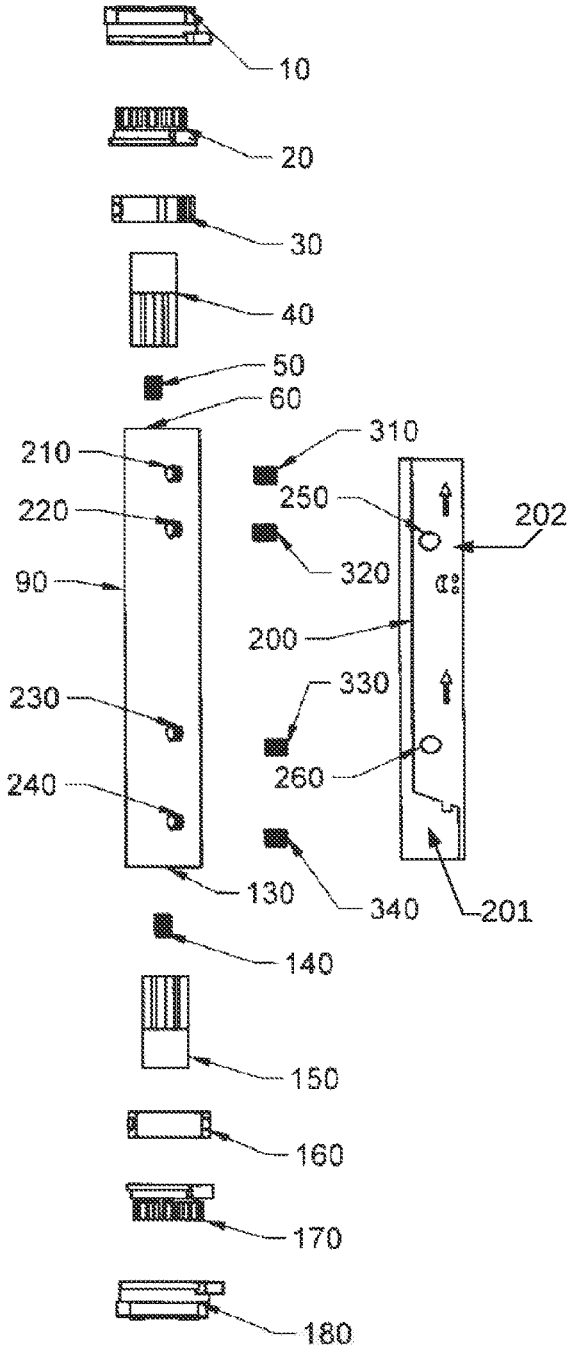
Figure 1D:
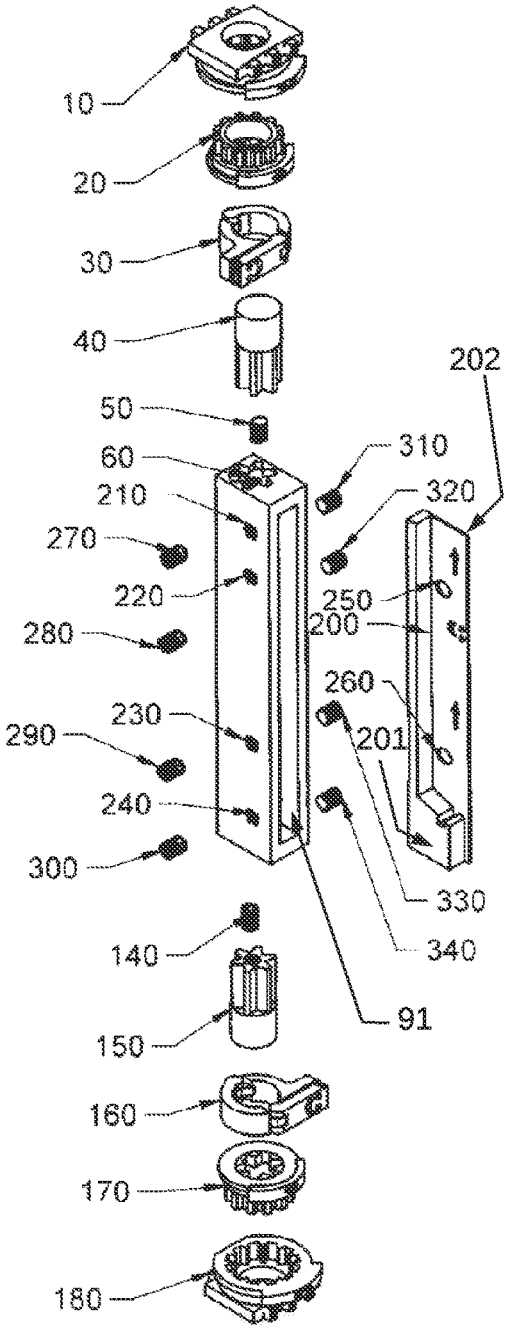

Reference will now be made in detail to some embodiments of the invention, examples of which are illustrated in the accompanying drawings.

FIGS. 1A, 1B, 1C, and 1D together form FIG. 1, which is a diagram showing a Kinetic Infinity Mount System (KIMS). FIGS. 2A and 2B together form FIG. 2, which is a diagram showing the KIMS having an outer housing 190 with an hourglass shape. In this example, the outer housing 190 has an hourglass shape. The outer housing 190 has two triangular pieces cut out on the sides and teeth along the top and bottom of the outer edge on the inside of the outer housing. The outer housing 190 holds a first outer gear 10 and a second outer gear 180. Each of the first outer gear 10 and the second outer gear 180 has two sides, a male side and a female side.

The male sides of the first outer gear 10 and the second outer gear 180 are shaped like a square with teeth along the top and bottom, which fit into the outer housing 190 to control the toe angle (e.g. toe in/toe out). The outer housing 190 has an hourglass shape. The female sides of the first outer gear 10 and the second outer gear 180 have circular shapes and mate with the first inner gear 20 and the second inner gear 170, respectively, in a circular pattern fashion. The female side of the first outer gear 10 accepts the male side of the first inner gear 20 and the female side of the second outer gear 180 accepts the second inner gear 170 as shown in the exploded views of FIGS. 1A-1D.

The first inner gear 20 and the second inner gear 170 control the camber angle (e.g. camber in/camber out). The first outer gear 10 and the first inner gear 20 attach to a first pin 40. The second outer gear 180 and the second inner gear 170 attach to a second pin 150. The first and second pins 40 and 150 attach to the fin box 90. A fin 100, which may be any type of fin including fins from FCS® (FCS® and FCS II®) and Futures® or similar, is fastened to the fin box 90. Various types of fins 100 can be attached via screws to the fin box 90 via the holes provided on the side of the fin box 90, including holes 70, 80, 110, 120, 210, 220, 230, and 240.

FIGS. 1A, 1B, 1C, and 1D also show a novel insert 200. Insert 200 comprises a base 201 coupled to a wall 202. In this embodiment, base 201 has a cross-sectional area that is slightly smaller than an interior 91 of fin box 90. This allows the base 201 and at least a portion of the wall 202 to fit within the interior 91 of fin box 90. Wall 202 includes holes 250 and 260. The base 201 and wall 202 of insert 200 form a slot that receives the fin 100. In one example, holes 250 and 260 are aligned with holes 80 and 110 when insert 200 is placed within fin box 90. In this example, screws or pins are used to secure the fin 100 to the insert 200 via holes 80, 110, 250, and 260.

The insert 200 shown in FIGS. 1A-1D is used to stabilize a fin 100. Base 201 and wall 202 can be manufactured or 3D-printed as a single structure, thereby reducing manufacturing costs. The wall 202 can be at various widths based on the fin 100 width, due to the ability to manufacture or 3D print the insert 200.

Figure 2A:
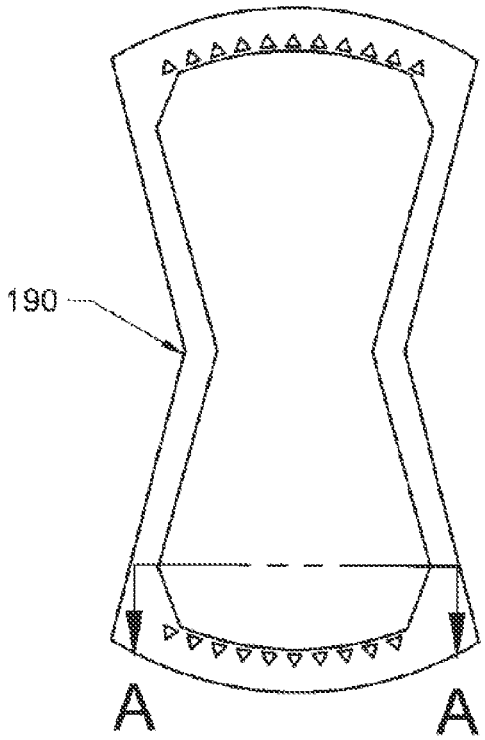
FIG. 2A is a plan view illustration of the outer housing of the KIMS.
Figure 2B:
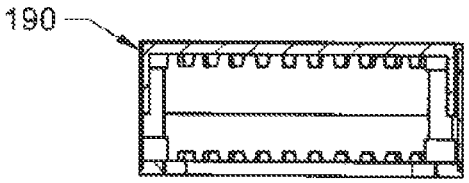
FIG. 2B is a cross-sectional view of the outer housing of the KIMS that shows teeth.
Figure 3:
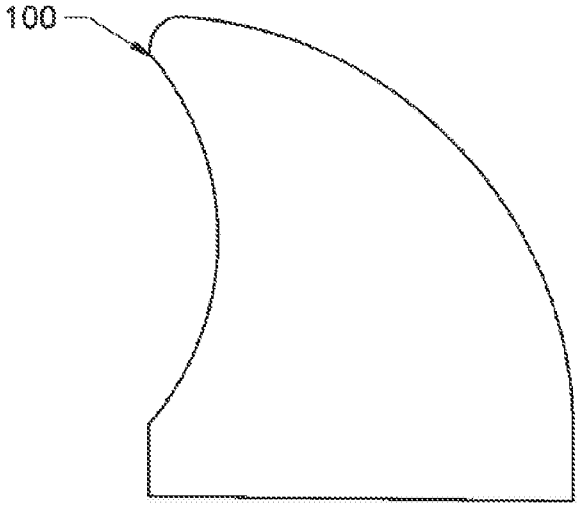
FIG. 3 is an illustration of a fin or surfboard skeg or fin.
Figure 4A:
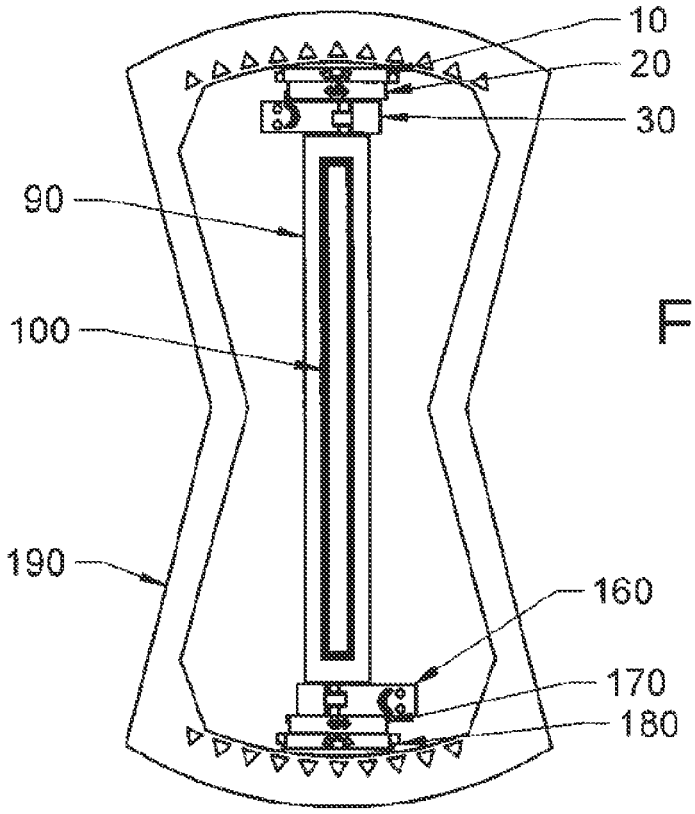
FIG. 4A is a plan view illustration of the KIMS fin box depicting both camber and toe set in the neutral direction.
Figure 4B:
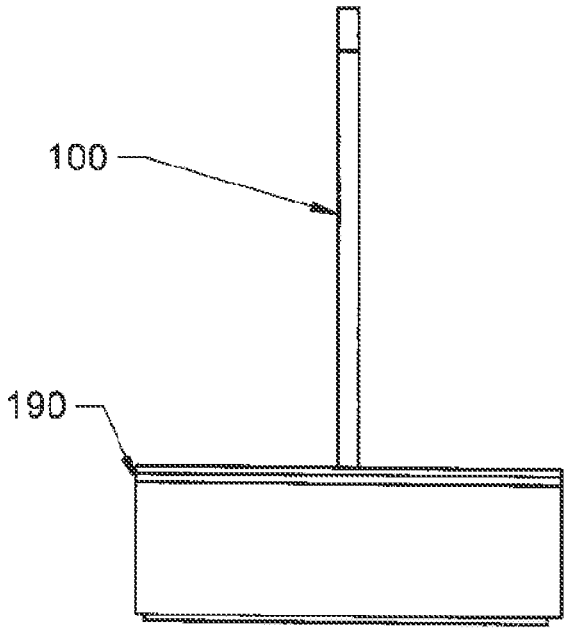
FIG. 4B is a transverse view illustration of the KIMS fin box depicting both camber and toe set in the neutral direction.
Figure 5A:
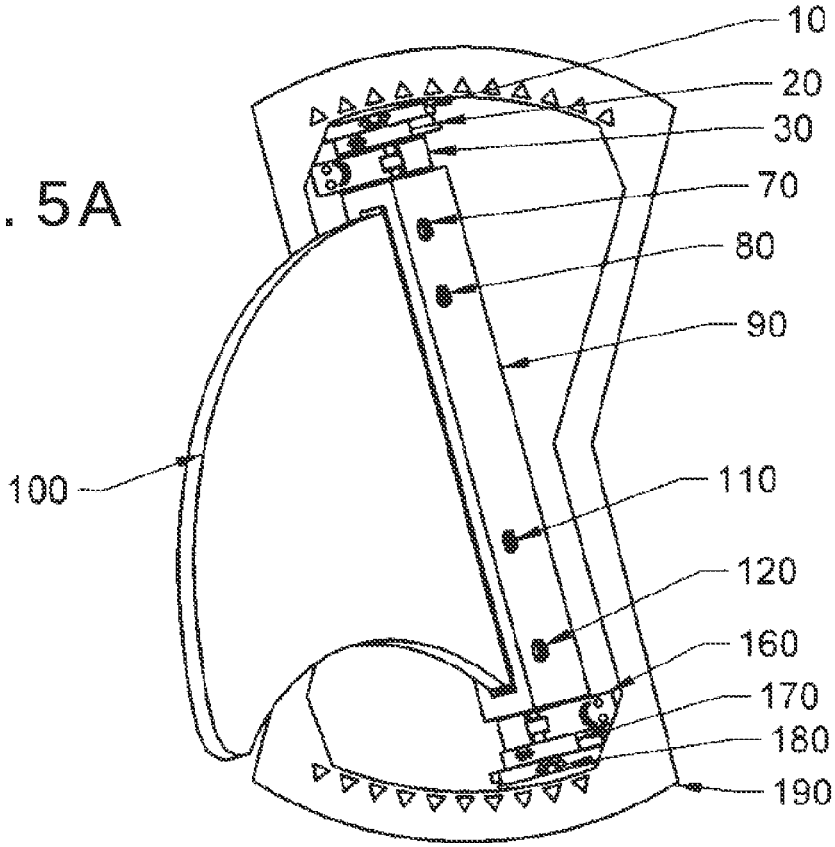
FIG. 5A is a plan view illustration of the KIMS fin box depicting both camber and toe set in a positive direction.
Figure 5B:
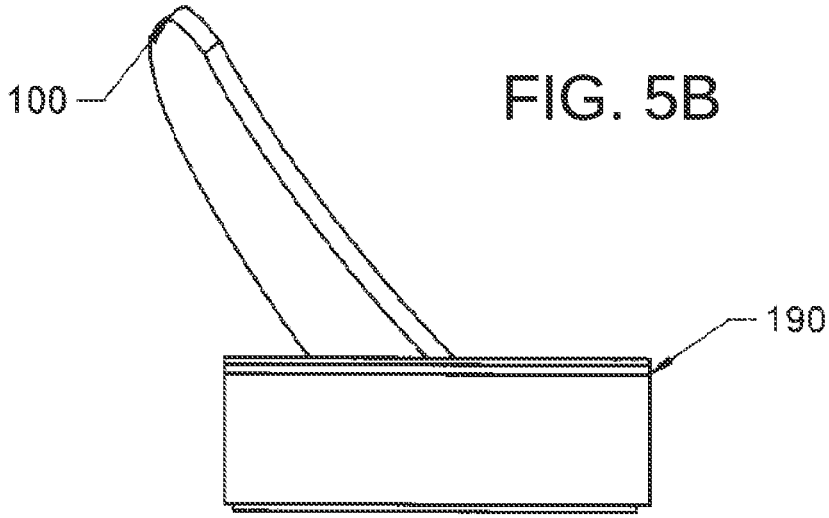
FIG. 5B is a transverse view illustration of the KIMS fin box depicting both camber and toe set in a positive direction.
Figure 8A:
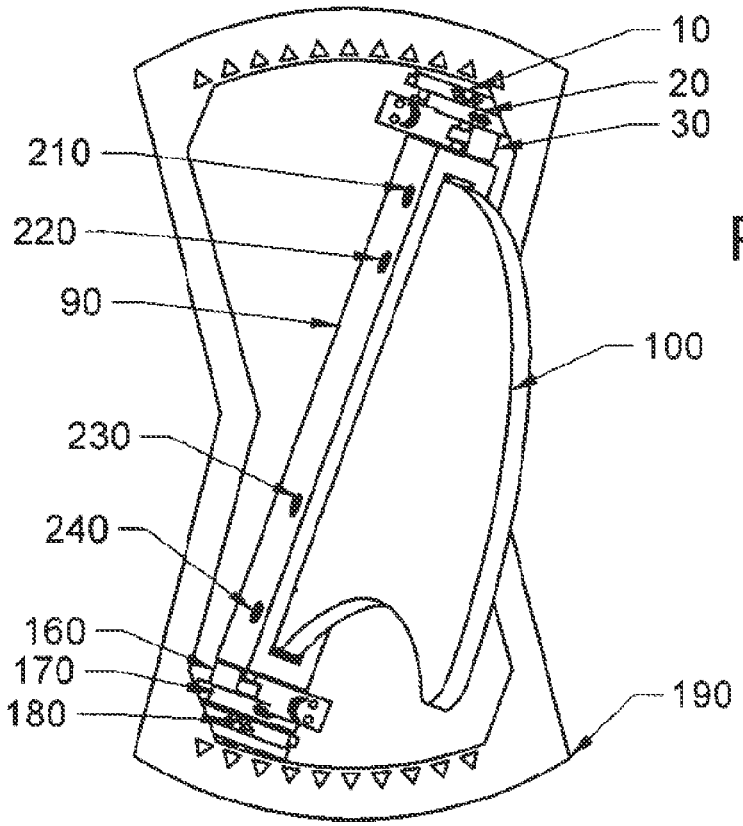
FIG. 8A is a plan view illustration of the KIMS fin box depicting both camber and toe set in a negative direction.
Figure 8B:
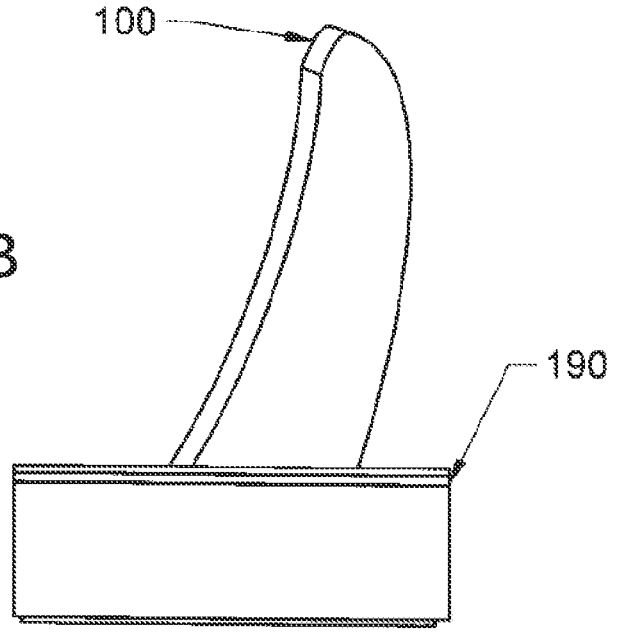
FIG. 8B is a transverse view illustration of the KIMS fin box depicting both camber and toe set in a negative direction.
Figure 9A:
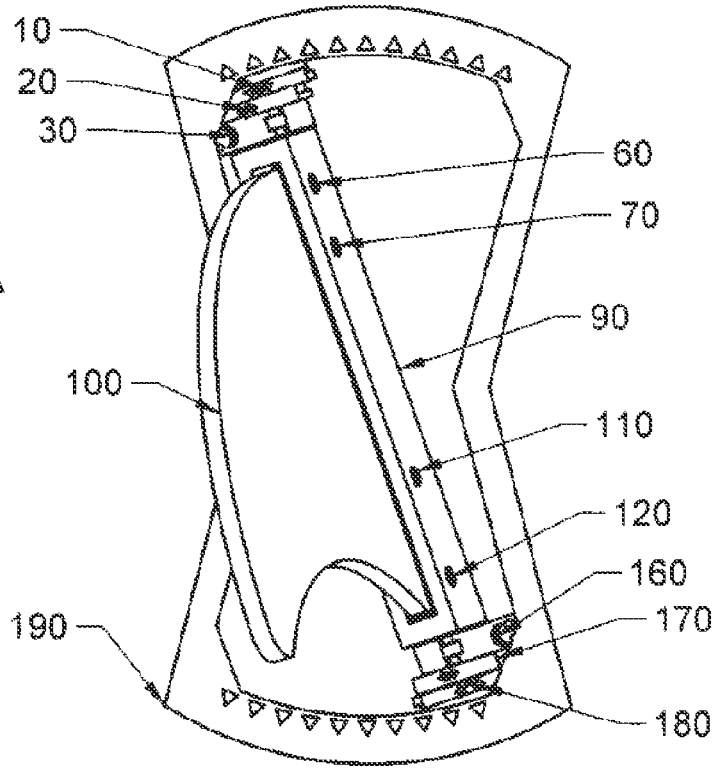
FIG. 9A is a plan view illustration of the KIMS fin box depicting both camber and toe set in a positive direction.
Figure 9B:
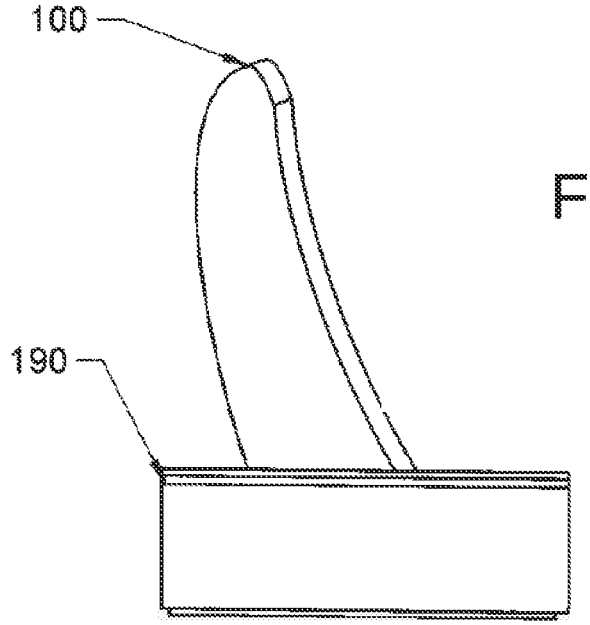
FIG. 9B is a transverse view illustration of the KIMS fin box depicting both camber and toe set in a positive direction.
Figure 10A:
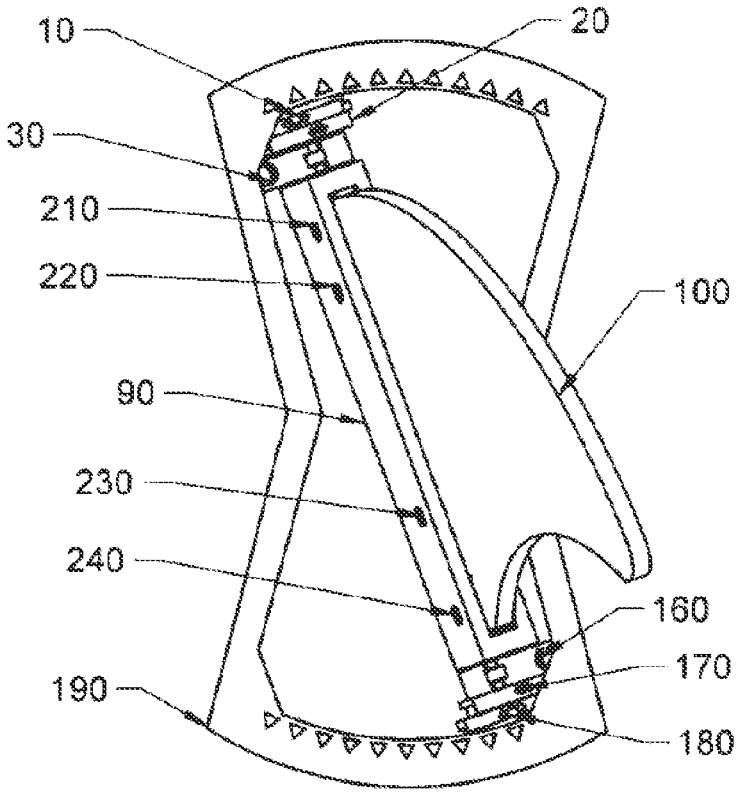
FIG. 10A is a plan view illustration of the KIMS fin box depicting camber set in a negative direction and toe set in a positive direction.
Figure 10B:
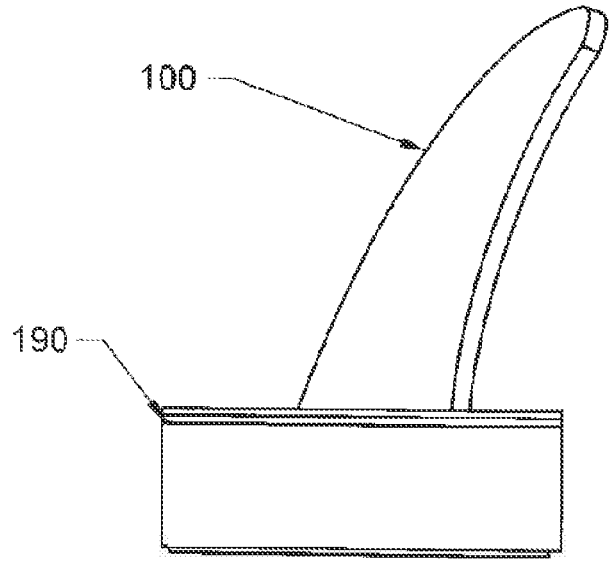
FIG. 10B is a transverse view illustration of the KIMS fin box depicting camber set in a negative direction and toe set in a positive direction.
Figure 11A:
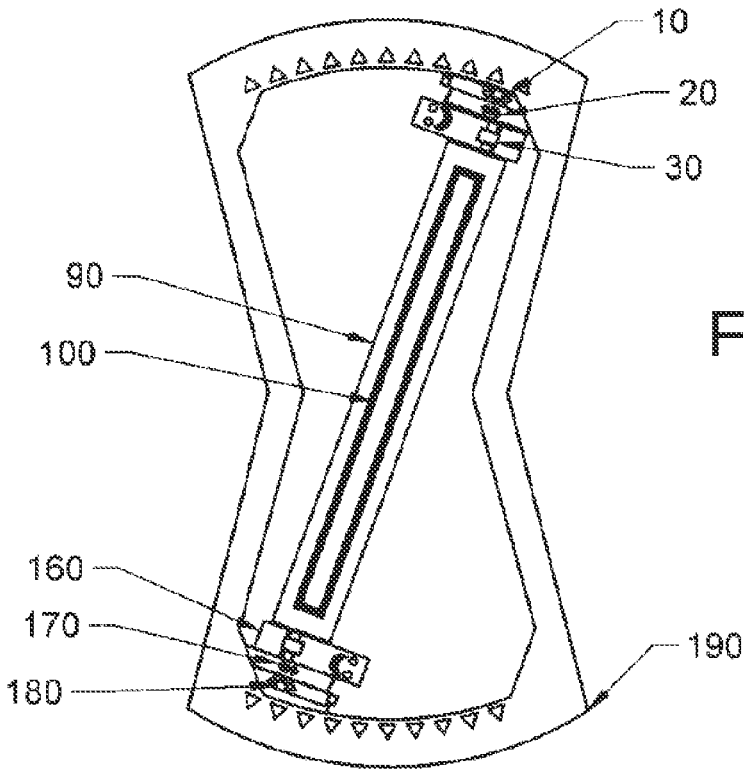
FIG. 11A is a plan view illustration of the KIMS fin box depicting camber set in a neutral direction and toe set in a negative direction.
Figure 11B:
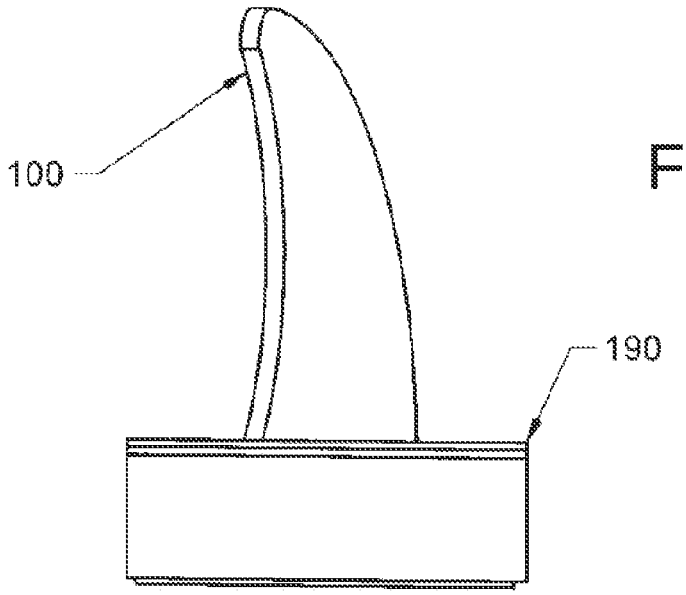
FIG. 11B is a transverse view illustration of the KIMS fin box depicting camber set in a neutral direction and toe set in a negative direction.
Figure 12A:
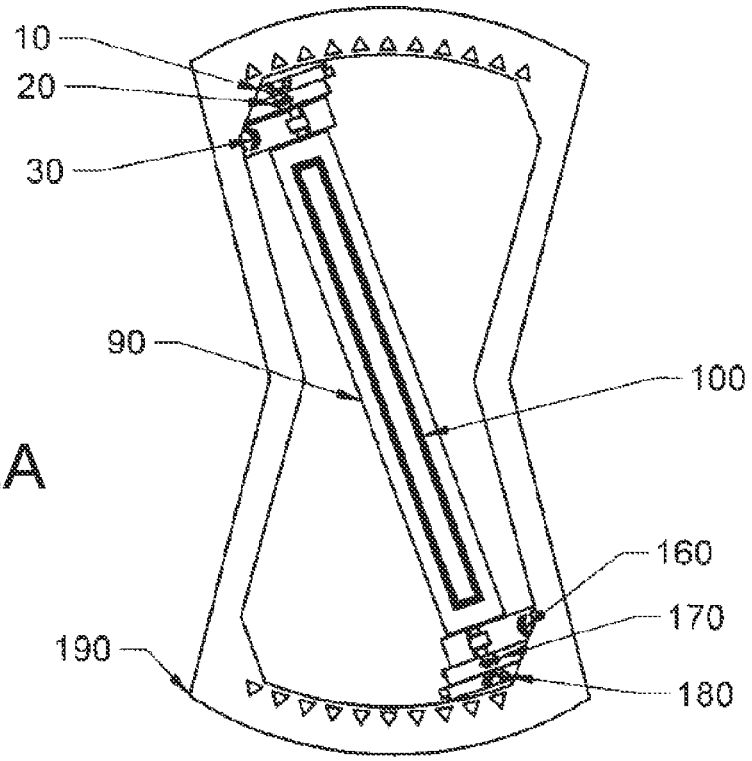
FIG. 12A is a plan view illustration of the KIMS fin box depicting camber set in a neutral direction and toe set in a positive direction.
Figure 12B:
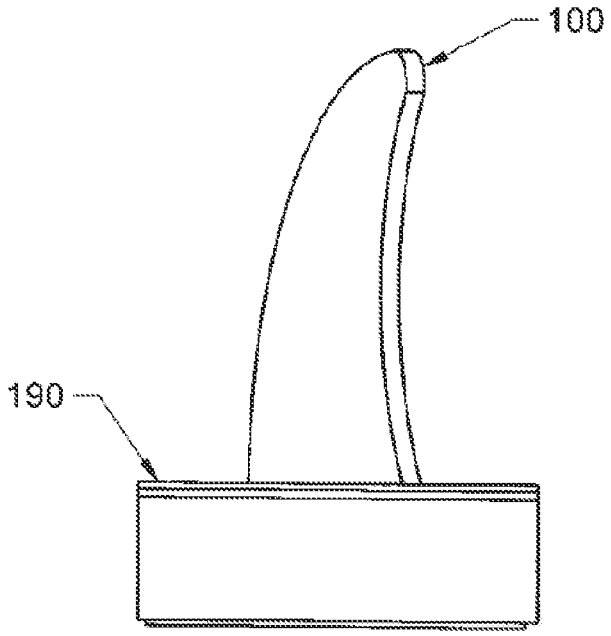
FIG. 12B is a transverse view illustration of the KIMS fin box depicting camber set in a neutral direction and toe set in a positive direction.
Figure 13A:
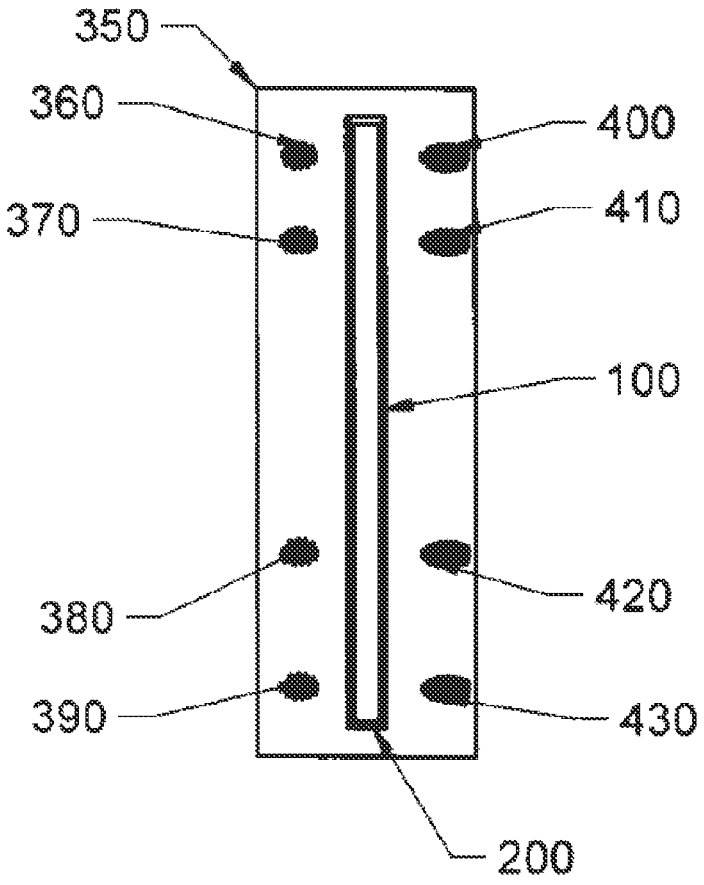
FIG. 13A is a diagram showing a novel box 350 with an insert 200.
Figure 13B:
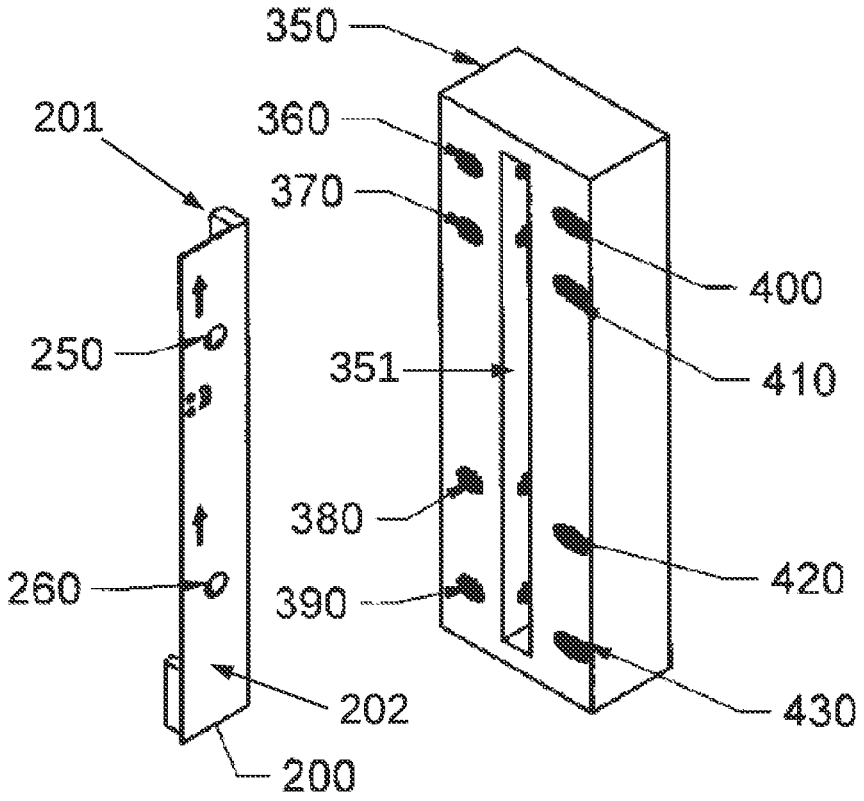
FIG. 13B is a diagram showing the novel box 350 and insert 200 with a fin embodiment.
Figure 13C:
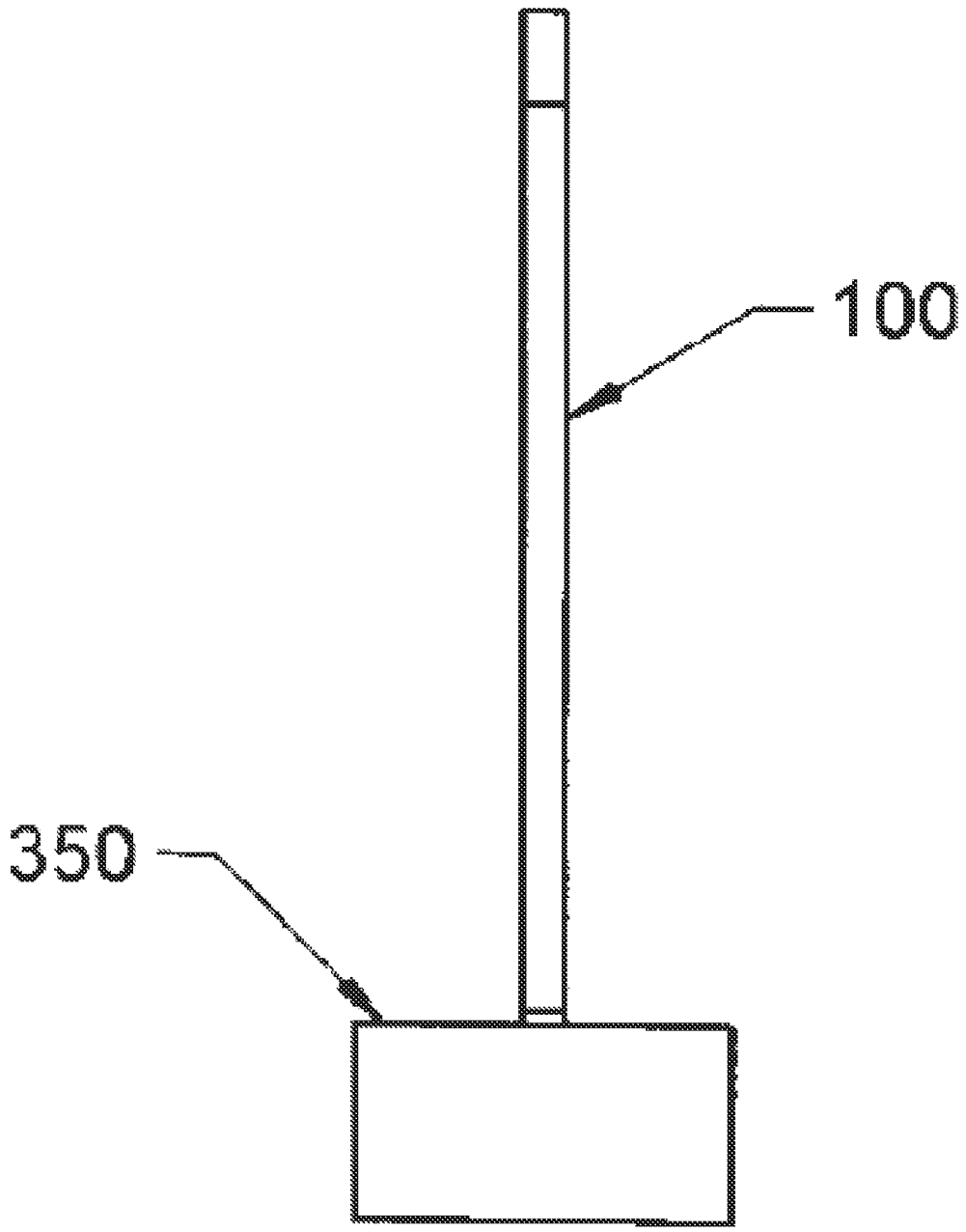
FIG. 13C is an isometric view of the novel box 350 and insert 200 embodiment.
Figure 13D:
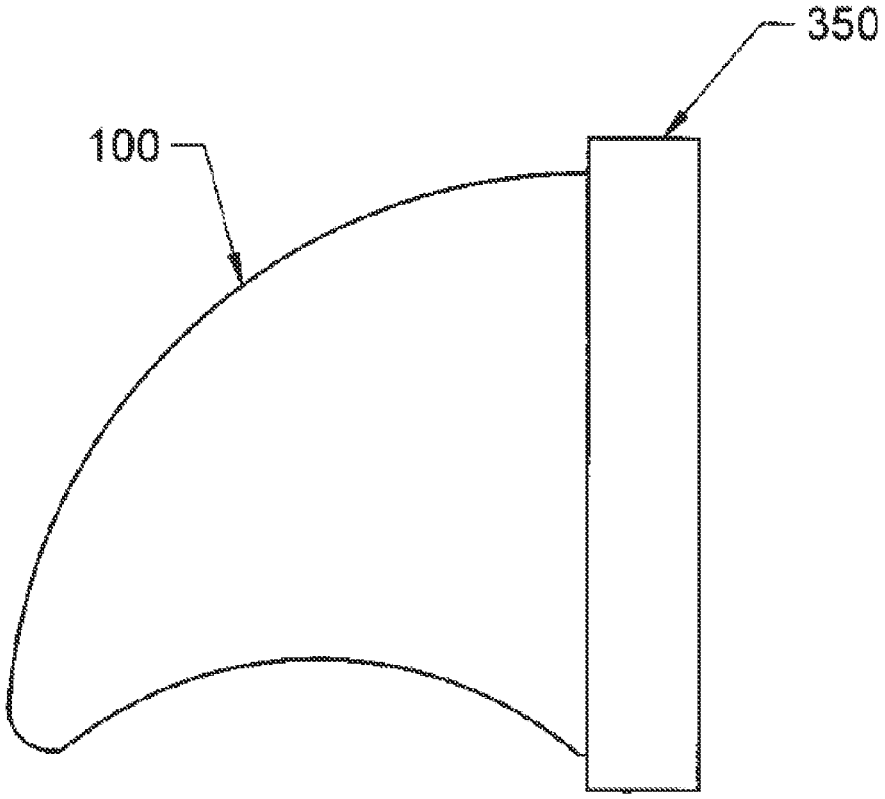
FIG. 13D is a cross-sectional view of the novel box 350 and fin 100.

The first pin 40 and the second pin 150 are cylindrically shaped on one end while the other end is shaped like a star, as shown in FIGS. 1A-ID. The star-shaped sides of the first pin 40 and the second pin 150 are attached to the fin box 90 via screws 50 and 140, respectively. The screws 50 and 140 are threaded into the fin box 90 via holes 60 and 130 into the first pin 40 and the second pin 150. In this embodiment, fin box 90 includes star-shaped indentations which surround holes 60 and 130 of fin box 90. The star-shaped indentations have a similar shape as the star-shaped sides of the first pin 40 and the second pin 150. The star portion of the first and second pins 40 and 150 allow the first and second inner gears 20 and 170 to move back and forth, but prevent the first and second inner gears 20 and 170 from sliding off the pins. The cylindrical side of the first and second pins 40 and 150 allow the first and second outer gears 10 and 180 to slide along the entire length of the pins 40 and 150, including the star-shaped side. The novel design of the fin mount system allows movement of the first and second outer gears 10 and 180 and allows movement of the first and second inner gears 20 and 170 simultaneously during toe angle adjustment (e.g. adjusting angle of toe in/toe out). This allows the fin box 90 to be moved and locked in place along a longitudinal axis in a negative direction (also known as negative camber) where the fin 100 can point towards the nose of the surfboard, or in a positive direction (also known as positive camber) where the fin 100 can point away from the nose of the surfboard as in FIGS. 5A through 12B.

The first and second inner gears 20 and 170 slide along the first and second pins 40 and 150 to change the toe angle of the fin by removing first and second collars 30 and 160. The camber angle of the fin 100 is set by the first and second inner gears 20 and 170 rotating along the first and second pins 40 and 150, respectively, about a horizontal axis of the fin box 90. The camber is adjusted by sliding only the first and second inner gears 20 and 170 along the first and second pins 40 and 150, respectively. The novel design of the fin mount system allows teeth movement of the first and second inner gears 20 and 170 during camber angle adjustment (e.g. adjusting angle of camber in/camber out). This allows the fin box 90 to be moved and locked in place along a horizontal axis in a negative direction where the fin 100 can point towards the nose of the surfboard, or a positive direction where the fin can point away from the nose of the surfboard as shown in FIGS. 5A through 12B. Both the toe and camber can be adjusted simultaneously or separately for desired fin movement and configuration.

The first and second collars 30 and 160 are disposed in between one of the first and second inner gears 20 and 170, respectively, and the fin box 90. The first and second collars 30 and 160 clasp around the respective first and second pins 40 and 150 in a manner that prevents longitudinal or front-to-back movement of the first or second outer gears 10 and 180 or movement of the first or second inner gears 20 and 170. The first and second collars 30 and 160 lock the fin box 90 into place once the desired camber angle and/or toe angle have been selected and adjusted.

The first and second pins 40 and 150 attach to the fin box 90. A fin 100, which may be any type of fin including fins from FCS® (FCS® and FCS II®) and Futures® or similar, is fastened to the fin box 90. Various types of fins 100 can be attached via screws to the fin box 90 via the holes provided on the side of the fin box 90, including holes 70, 80, 110, 120, 210, 220, 230, and 240.

FIGS. 13A, 13B, 13C, and 13D show diagrams of a novel fin box 350. Fin box 350 includes an interior 351 and holes 360, 370, 380, 390, 400, 410, 420, and 430. Fin box 350 is compatible with novel insert 200. For example, base 201 has a cross-sectional area that is slightly smaller than an interior 351 of fin box 350. This allows the base 201 and at least a portion of the wall 202 to fit within the interior 351 of fin box 350. In one embodiment, screws are inserted into holes 360, 370, 380, 390, 400, 410, 420, and 430 to secure fin 100. In the example shown in FIG. 13C, screws are inserted without protruding from a top surface of the finbox 350.

What is claimed is:

1. A fin mount system for a surfboard comprising:

an outer housing having an inside and an outside;

a fin box, wherein the fin box is disposed within the inside of the outer housing;

a first outer gear;

a second outer gear, wherein the first outer gear and the second outer gear control a toe angle of the fin box;

a first inner gear;

a second inner gear, wherein the first inner gear and the second inner gear control a camber angle of the fin box;

a first collar, wherein the first collar is disposed between the first inner gear and a first end of the fin box;

a second collar, wherein the second collar is disposed between the second inner gear and a second end of the fin box, and wherein the first end of the fin box is opposite the second end of the fin box; and a fin box insert, wherein the fin box insert includes a base and a wall, and wherein the wall includes a plurality of holes.

2. The fin box insert of claim 1, further comprising:

a fin having a first end and a second end, wherein the first end has a length, a width, and a height, and wherein a width of the fin box insert and the width of the first end of the fin are not greater than a width of the fin box.

3. The fin box insert of claim 2, wherein the fin includes at least two tabs, and wherein the at least two tabs are secured to the fin box via the fin box insert.

4. The fin box insert of claim 1, wherein the fin box has a plurality of holes disposed in the fin box.

5. The fin box insert of claim 4, wherein when the fin box insert is disposed within the fin box, at least one of the plurality of holes in the fin box insert is disposed along at least one of the plurality of holes in the fin box.

6. The fin box insert of claim 5, wherein the fin box insert is secured to the fin box via screws.

7. The fin box insert of claim 1, wherein a portion of the end of the fin box insert is disposed within an interior of a fin box.

8. The fin box insert of claim 1, wherein the length of the fin box is greater than a length of the fin box insert.

9. The fin box insert of claim 1, wherein the fin box insert includes a groove disposed on an upper end of the fin box insert.

* * * * *